US007476010B2

(12) United States Patent
Johnson

(10) Patent No.: US 7,476,010 B2
(45) Date of Patent: Jan. 13, 2009

(54) FIRE RATED DOWNLIGHTS

(75) Inventor: Andrew Joseph Johnson, Gerrards Cross (GB)

(73) Assignee: Aurora Limited (GB)

( * ) Notice: Subject to any disclaimer, the term of this patent is extended or adjusted under 35 U.S.C. 154(b) by 0 days.

(21) Appl. No.: 11/419,920

(22) Filed: May 23, 2006

(65) Prior Publication Data

US 2007/0109796 A1 May 17, 2007

(30) Foreign Application Priority Data

Aug. 13, 2004 (WO) ..... PCT/GB2004/003481
May 23, 2005 (GB) ..... 0510494.8

(51) Int. Cl.
*F21V 29/00* (2006.01)

(52) U.S. Cl. ..... 362/373; 362/364; 362/148; 362/294

(58) Field of Classification Search ..... 362/373, 362/147–148, 364; 52/741.3
See application file for complete search history.

(56) References Cited

U.S. PATENT DOCUMENTS 4,400,673 A 8/1983 Gilman ..... 337/380
4,754,377 A 6/1988 Wenman ..... 362/148
6,105,334 A * 8/2000 Monson et al. ..... 52/741.3
2007/0068099 A1 3/2007 Kovacs

FOREIGN PATENT DOCUMENTS

| | | |
|---|---|---|
| EP | 0 908 668 | 4/1999 |
| EP | 0 983 471 | 3/2000 |
| EP | 1 367 191 | 12/2003 |
| EP | 1 752 704 A2 | 2/2007 |
| GB | 2 270 936 | 3/1994 |
| GB | 2 297 609 | 7/1996 |
| GB | 2 326 467 | 12/1998 |
| GB | 2 391 023 | 1/2004 |
| GB | 2 415 245 | 12/2005 |
| GB | 2 421 070 | 6/2006 |
| GB | 2 422 191 | 7/2006 |
| WO | WO 98/12472 | 3/1998 |
| WO | WO 99/02919 | 1/1999 |
| WO | WO 2005/121642 | 12/2005 |

* cited by examiner

*Primary Examiner*—Ali Alavi
(74) *Attorney, Agent, or Firm*—Hayes Soloway P.C.

(57) ABSTRACT

A casing for a downlight having a tubular body from which the light of a lamp when installed in the body is emitted from the front of the body and having a rear end wall closing the body from the rear, wherein intumescent material is placed within the tubular body lining the tubular wall of the tubular body.

23 Claims, 11 Drawing Sheets

FIRE RATED DOWNLIGHTS

FIELD OF THE INVENTION

The present invention concerns improvements in and relating to fire rated downlights.

BACKGROUND OF THE INVENTION

Downlighters that are adapted to be installed into ceiling and/or roof spaces are inherently at risk of compromising the integrity of the ceiling and/or roof space. They are generally installed into an aperture in the ceiling that has to be relatively wide to accommodate the downlighter assembly and thereby compromises the ability of the ceiling to contain a fire in a room or even a fire caused by the light fitting itself failing. In order to compensate against these increased risks, it is generally required that downlighters incorporate adaptations to improve their fire barrier capabilities and which generally include the provision of intumescent materials associated with the downlighter assembly and which expand in the heat of fire to occlude the openings defined by the downlighter.

Since downlights generate a substantial amount of heat in operation, it is generally necessary that they be provided with ventilation apertures. However, fire rating requires that any ventilation apertures be sealed off by the intumescent material in event of a fire. In operation it is important that the intumescent material is stable and not triggered by the high levels of heat generated in normal operation of the light but that in event of a fire it expands to reliably occlude the openings.

Normal measures to fire rate downlighters include, for example, provision of hoods or tents that seat over the downlighter assembly in the manner of a shroud and which effectively entomb the downlighter in event of a fire. See, for example, GB-2,270,936.More recently downlighter assemblies have been adapted to incorporate intumescent material more intimately associated with the downlighter itself and commonly mounted in immediate proximity to the casing of the downlighter at the rear end of the casing in order specifically to occlude ventilation apertures in the rear end of the casing. In general the intumescent material is applied as a sheetllayer that is laminated or sandwiched to the end wall of the lamp casing either internally or externally. However, the positioning of a layer of intumescent material at the end of a downlighter assembly may compromise the flow of air through the downlighter. This can cause excessive heat to build up during operation. This has at least two disadvantages. Firstly, bulb life may be significantly reduced and secondly, the intumescent material may be triggered to expand because of the excessive heat resulting from continuous running of the bulb. In order to avoid this, intumescent material which starts to expand at a higher temperature tends to be used. This makes the whole assembly less sensitive and slower to close up in the event of a fire. Further drawbacks of this prior art include that they need to be used only with aluminium reflector lamps, being incompatible for use with the popular dichroic reflector lamps since these latter direct the heat from the lamp rearwardly and which would cause excessive heat build up inside the casing reducing lamp life and risking premature activation of the intumescent material.

It is an object of the present invention to provide a fire rated downlighter arrangement that provides an alternative or improved arrangement for fire retardance.

SUMMARY OF THE INVENTION

According to a first aspect of the present invention there is provided a casing for a downlight having a tubular body from which the light of the lamp when installed in the body is emitted from the front of the body and having a rear end wall closing the body from the rear, wherein intumescent material is placed within the tubular body lining the internal tubular wall of the tubular body. Unlike the prior art arrangements, the intumescent material is not simply placed as a sheet over the rear end wall of the tubular body internally or externally but rather is formed as a continuous or discontinuous sleeve that lines the tubular wall of the casing body and will expand inwardly (radially inwardly in the case of a circular cylindrical tube) to substantially fill the void within the casing and not simply occluding the rear end of the casing to cover ventilation apertures at the end of the casing.

The provision of the intumescent material as a sleeve or lining of the internal tubular wall of the tubular body of the casing rather than as an end wall covering has been found to provide an efficient way of improving the fire rating of the downlighter and contrary to what was otherwise expected, not inherently vulnerable to triggering of the intumescent material to expand by its proximity to the lamp.

In the preferred arrangement the intumescent material is formed as a 1 or 2 mm thick sheet and is located within the tubular body as a liner extending substantially from the end wall or proximate thereto toward the front of the casing but suitably terminating short of the front of the casing. In a first preferred embodiment the intumescent material terminates at least 2 cm and preferably of the order of 5 cm short of the front end of the casing to improve clearance from the halogen lamp body 2 that is installed in use in the casing where the lamp body is tapered and the front face of the lamp is substantially level with the front end of the casing. This generally provides adequate clearance of the intumescent material from the lamp.

Unlike the prior art arrangements, the arrangement of the present invention provides for much greater filling of the void within the casing to enhance the fire barrier properties, The end wall of the casing body may even be free of any intumescent material and does not necessarily need to be blanked off by an intumescent material sheet placed against it. The present invention thus substantially improves airflow and, unlike the prior art, allows the use of dichroic reflector lamps within these casings In further refinements, the casing may further be provided with intumescent material on the external face of its tubular wall facing laterally externally and the purpose of which is to expand laterally/radially outwardly to function as an anchor that holds the downlighter assembly in place in the ceiling/roof. Where such provision is made it suitably is spaced a selected distance back from a front fascia rim/flange of the front end of the downlighter casing so as not to interfere with mounting in an aperture in the ceiling or roof but to be able to expand into the roof or ceiling space behind the aperture. Thus, in accordance With one aspect of the present invention, there is provided a method of anchoring a downlighter casing in situ in a roof or ceiling wherein the method comprises the steps of providing a downlighter casing with intumescent material on the outer face of a tubular wall of the casing to expand laterally/radially outwardly when exposed to fire and thereby serve as an anchor holding the downlighter casing in place.

BRIEF DESCRIPTION OF THE DRAWINGS

A preferred embodiment of the present invention will now be more particularly described, by way of example, with reference to the accompanying drawings, wherein.

DESCRIPTION OF THE PREFERRED EMBODIMENT

Figure 1:
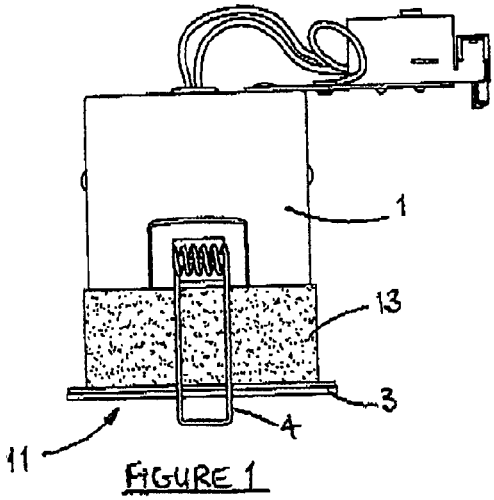
FIGS. 1 to 3 are, respectively, a side elevation view, rear elevation view and front elevation view of the downlighter assembly.
Figure 2:
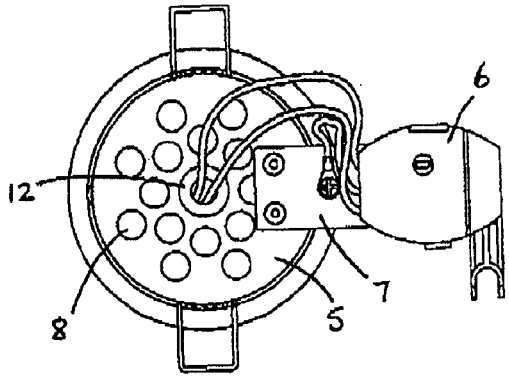

The present invention will now be described by way of example only. These are not the only ways that the invention may be put into practice but they are the best ways currently known to the applicant.

Referring to FIGS. 1 to 5, the downlighter assembly shown is relatively conventional in so far as it comprises a circular cylindrical casing 1 that is adapted to house a downlight lamp such as a halogen lamp 2 (illustrated here schematically in FIG. 5) and having an annular front flange 3 to butt up against the rim of the ceiling aperture in which the downlighter is being installed. A pair of resiliently sprung mounting clips 4 project laterally from either side of the casing 1 and are forwardly biased to press against the inner/upper surface of the ceiling to hold the casing 1 in place.

The circular cylindrical casing 1 resembles a canister with a rear end wall 5 and an open front end 11 through which the light from the lamp is projected directly or through a window.

The rear end wall 5 of the casing has a central aperture 12 through which passes a pair of power cables as fed from a terminal block 6 carried on a mounting arm 7. The arm 7 is bolted, welded or otherwise mounted to the casing 1 substantially coplanar with the end wall 5 and projecting laterally therefrom.

In common with most fire rated downlighter casings, the casing 1 is provided with a 20 plurality of ventilation apertures 8 in its rear end wall 5. These are, however, generally larger and more numerous than those used in the prior casings. Here there are, for example, 14 apertures all of 3.5 mm radius that perforate the rear end wall 5 and where the end wall 5 has a diameter of 75 mm. Accordingly, the proportion of the surface area of the end wall 5 occupied by ventilation apertures 8 is at least of the order of about 20% and which is substantially greater than in most downlighter casings. Furthermore, the diameter of the casing is, at about 60 mm to about 80 mm, substantially larger than that of the art and the casing is suitably at least about twice as long as the lamp.

The relatively large volume of the casing 1 and the relatively high ventilation aperture area facilitate ventilation. The positioning of the terminal block 6 offset from the rear end of the casing 1 also assists the functioning of the downlighter.

Figure 4:
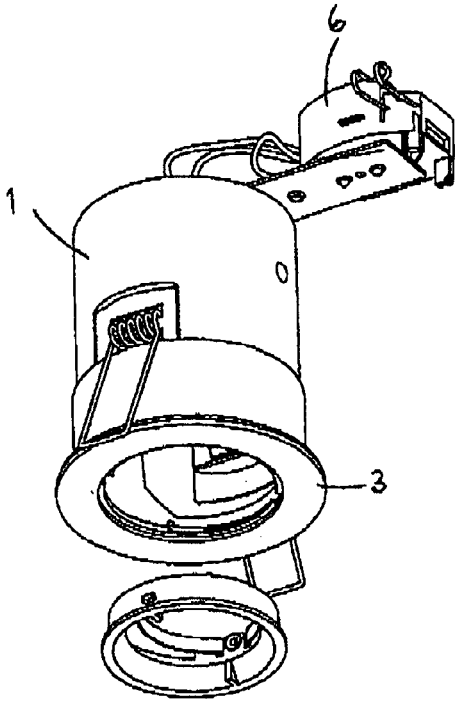
FIG. 4 is a perspective view of the downlighter assembly with a front fascia removed to more clearly show the location of the intumescent sleeve within the downlighter.
Figure 3:
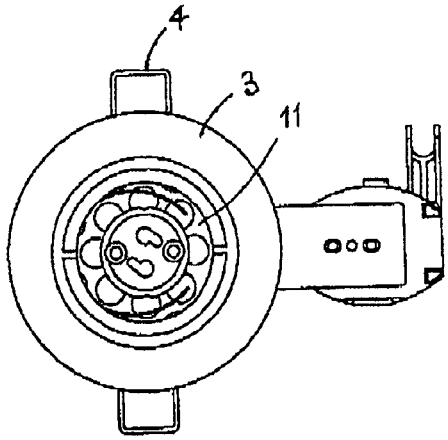
Figure 5:
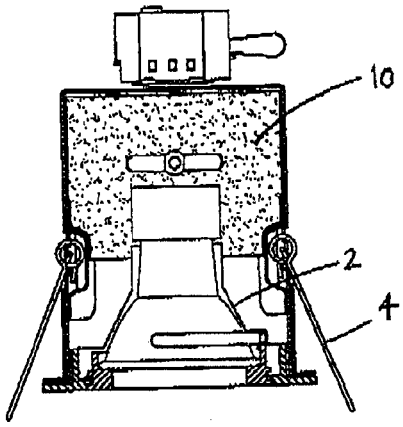
FIG. 5 is a longitudinal sectional view of the downlighter as viewed from one side.
Figure 6:
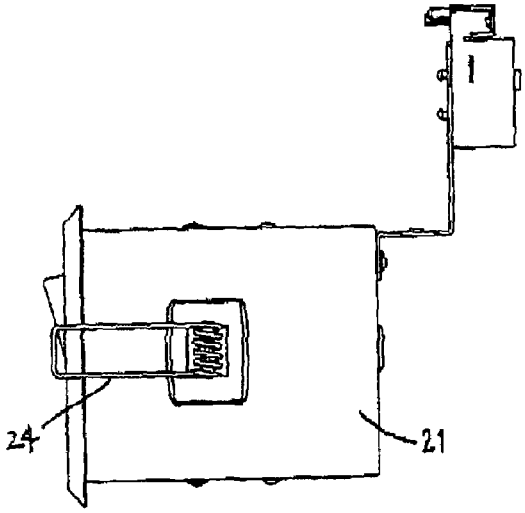
FIGS. 6 to 11 are, respectively, a side elevation view, a rear elevation view, a side elevation view, a front elevation view, a perspective view and a longitudinal sectional view as viewed from one side of an eyeball downlighter according to a second embodiment of the present invention.
Figure 7:
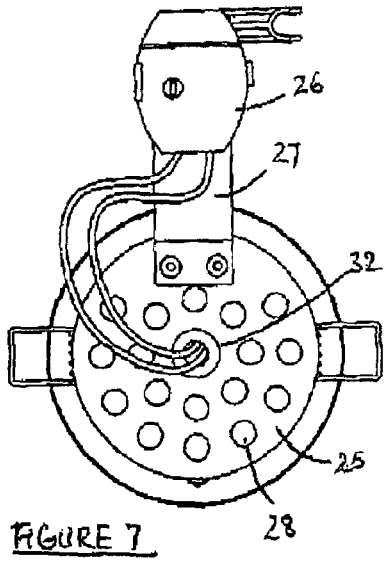
Figure 8:
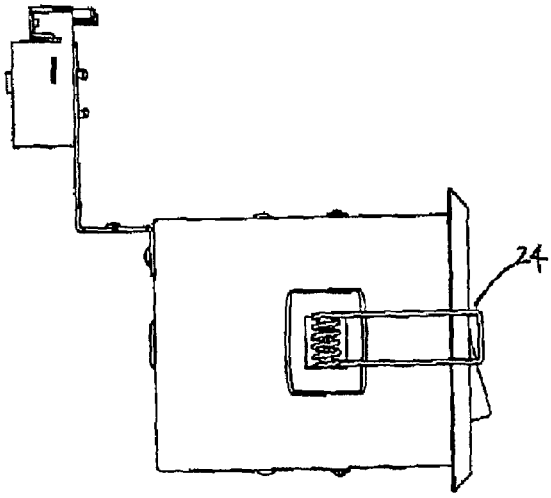
Figure 9:
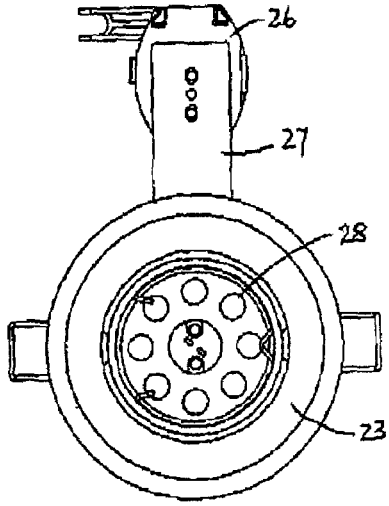
Figure 10:
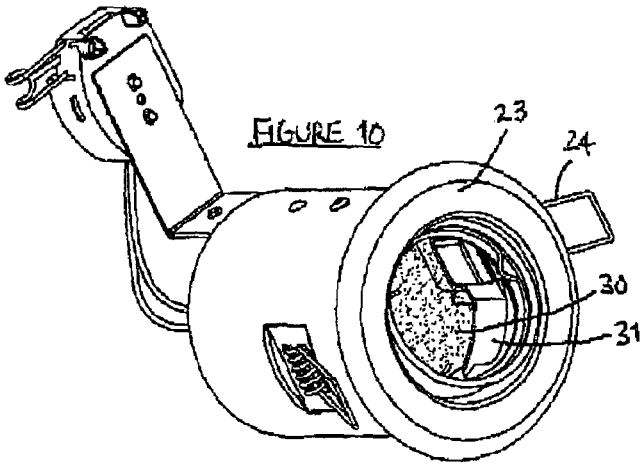
Figure 11:
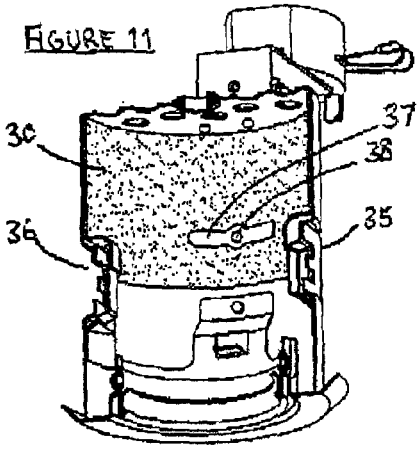

Turning to FIGS. 4 and 5, from those figures the distinctive arrangement of the intumescent sheathing of the downlighter can be seen. In contrast to the conventional arrangement of intumescent sheet positioned as a disc over the rear end wall 5, the downlighter assembly of the present invention has a sleeve 10 of intumescent sheet material positioned lining its internal tubular wall surface and extending from close proximity to the rear end wall 5 to a position proximate but preferably short of the front end of the casing 1. In one preferred embodiment the intumescent material sleeve 10 extends for of the order of one third to two thirds the length of the body 1. Where the body 1 is of the order of 10 cm in length, therefore, the sleeve is preferably approximately half that length, i.e. 5 cm long and suitably falls short of the front end of the casing 1 by at least 2 cm and suitably at least 3-5 cm. This arrangement has been found optimal for filling the void cavity within the casing 1 in the event of a fire while ensuring that the intumescent material is not vulnerable to heat from the halogen lamp. The sleeve 10 is suitably of the order of 1 mm thick for a casing that is 80 mm or less in diameter and of the order of 2 mm thick for larger diameters, eg 3.5 to 4.5 inch diameter, assuming that the selected intumescent material has a high expansion ratio of the order of 40:1.

As a further provision to enhance the fire barrier effectiveness of the downlight casing 1, it suitably has an elastomeric/slicone annular washer or seal 11 mounted behind the annular front flange 3 to provide a relatively airtight seal between the flange 3 and rim of the ceiling aperture in which the casing 1 is mounted in use. Thus, in use, the seal is sandwiched between the lower or underside surface of the ceiling or other surface into which the downlight lamp is fitted and the annular front flange 3 extending from the body of the downlight. This seal ensures that the downlight casing sits evenly around the hole in the ceiling/surface.

As a further provision to enhance the fire resistance of the downlighter casing, an annulus of intumescent material 13 may optionally be positioned around the lower edge of the casing sidewall. In the event of a fire, this annulus or collar of intumescent material expands to fill any gaps or irregularities between the hole in the ceiling/surface and the casing body.

A wide range of intumescent materials are known per se and can be used in this application as selected by the materials specialist. The intumescent material is suitably graphite based but could be epoxy-, mastic- or water-based. Particularly preferably it has a free expansion ratio that is of the order of 20:1 to 50.1, ie is able to expand to fill 20 to 50 times its own volume when exposed to the heat of a fire. It is important to select a material which will not react to the normal running temperature of the downlight fitting but which will react when subjected to the temperatures experienced in a fire that are of the order of 150 degrees Centigrade or higher. One preferred intumescent material is a (preferably non-alkaline) fibreglass containing intumescent sheet material. An example such composition has 50% ceramic fibre content, 10% organic fibre content, 10% adhesive content and 30% intumescent content, and includes $SiO_2$, $Al_2O_3$, CaO, MgO and $B_2O_3$.

A further downlight assembly according to the present invention is shown in FIGS. 6 to 11 inclusive. This embodiment is shown without the bulb and bulbholder for clarity. A similar numbering scheme to that used in FIGS. 1 to 5 has been used. FIGS. 6 to 11 illustrate a circular cylindrical case 21 made of metal with a sidewall and a rear end wall 25 and an open front end 31 through which light from the lamp (not shown) is projected. The sides of the canister are indented with indentations 35,36 to accommodate the spring body of the spring clips 24. In this way the integrity of the canister can be maintained whilst allowing the spring body to be recessed into the canister, This is an important design point because, without this feature, the springs would have to project from and be mounted proud of the canister body. This would require a much wider flange 23, leading to a less aesthetically pleasing fitting. Alternatively, the body of the casing would need to be perforated to provide mounting points for the springs. This would compromise the integrity of the fitting.

It will be seen from this and the earlier example that sleeve 30 takes the form of a substantially cylindrical sleeve of intumescent material. In this later example the sleeve is held in place by the arms of resilient clip 37, attached at point 38, and extending part way around the inner circumferential surface of the wall of the canister.

In this description, "substantially cylindrical" means conforming approximately to the shape of a hollow cylinder. It will be appreciated that there is no need or requirement for it to be an exact uniform cylinder since the invention will work equally well if it is a misshapen cylinder. Nor does the cylinder need to be complete around its entire circumference. It may be, as will be described below, that there is some component which prevents the intumescent material extending in a continuous and uninterrupted manner around the entire circumference of the inner surface of the canister. Because of the nature of intumescent material and the way it expands to fill any irregular space, the invention works perfectly well even if the intumescent material is interrupted. It is sufficient if part of the inner tubular wall of the tubular body of the casing is lined with intumescent material.

It will be appreciated that, while the examples show a downlight having a generally circular cylindrical tubular body, this is not essential. Any form of tubular body may be used and in fact the body could be frustoconical in shape.

Figure 12:
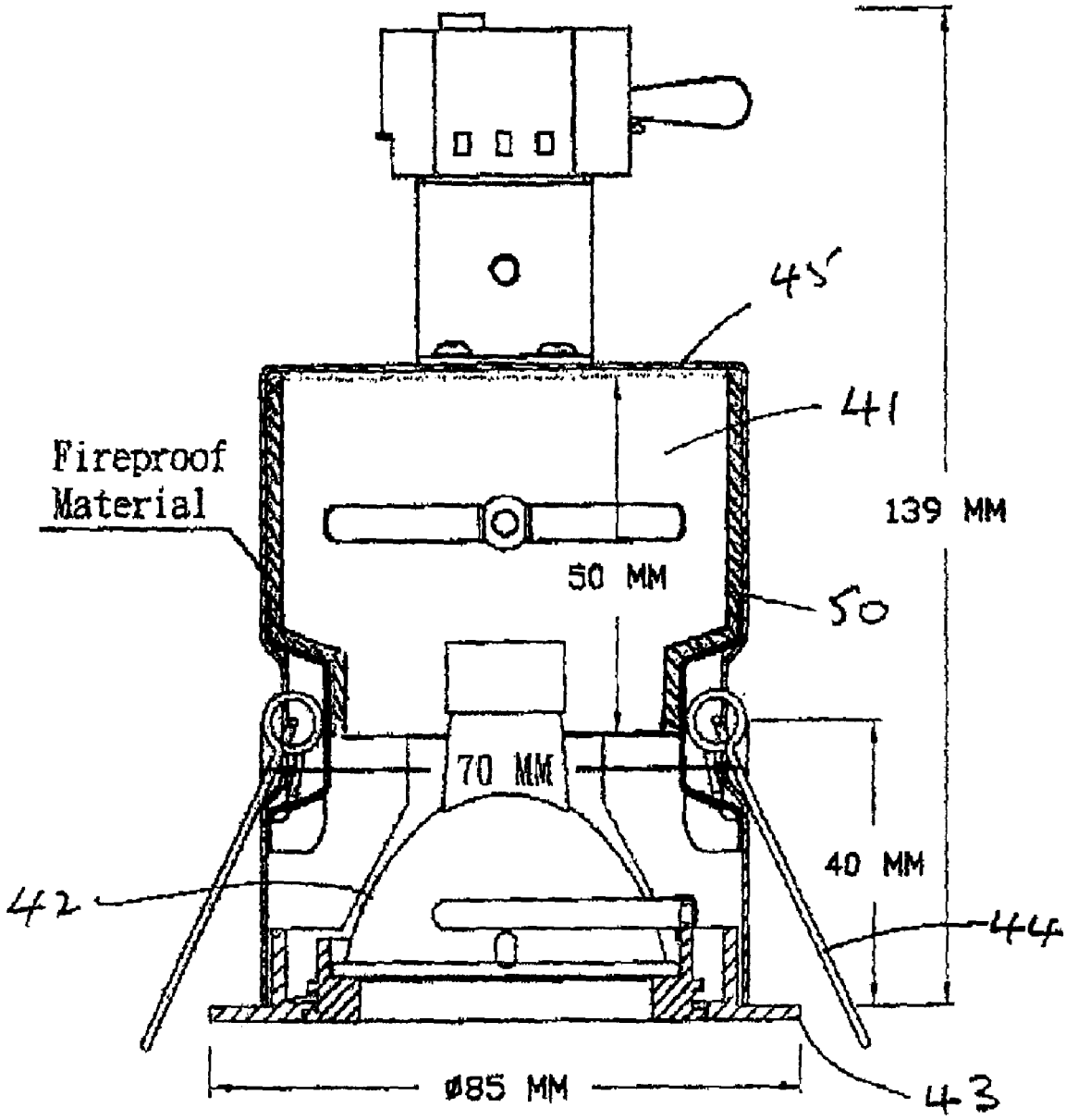
FIG. 12 shows a longitudinal sectional view as viewed from one side of a downlighter according to a third embodiment of the present invention.

A further embodiment is illustrated in FIG. 12 where, once again, a similar numbering scheme to that used in FIGS. 1 to 5 has been used. FIG. 12 clearly shows the extent of the intumescent lining 50 within the tubular body of the casing This stops short of the very hottest part of the bulb.

Further embodiments are illustrated in FIGS. 13 to 17 inclusive. In these embodiments the casing is of somewhat different construction from those embodiments described above, having a double walled arrangement. The casing comprises an outer circular cylindrical tubular body 71 with a rear end wall 75. The front of the tubular body 81 is open and is adapted to accommodate a lamp 72 and a lamp holder assembly 89. Attached to and integral with the outer tubular body is an inner tubular body 84 which is open at both ends. This acts as a form of chimney, allowing heat from the lamp to pass freely up through the body of the fitting. Ventilation holes 88 are provided in the sides of the outer tubular body instead of or as well as on the end rear wall 75. This double skinned effect allows the outside of the casing to run at a much lower operating temperature during continuous running of the lamp than in the previously described embodiments with only a single wall to the casing. The sleeve of the intumescent material 80 is located inside the inner tubular body 84 and is mounted so as to be located at the end of the inner tubular body farthest from the lamp.

It is important to note that there is space 90 between the end of the intumescent sleeve 80 and the rear end wall 75 to allow for the flow of hot air away from the lamp and through the ventilation holes 88 in the outer tubular body 71. This space ensures that the free flow of air from the lamp and out of the casing is not compromised.

Figure 14:
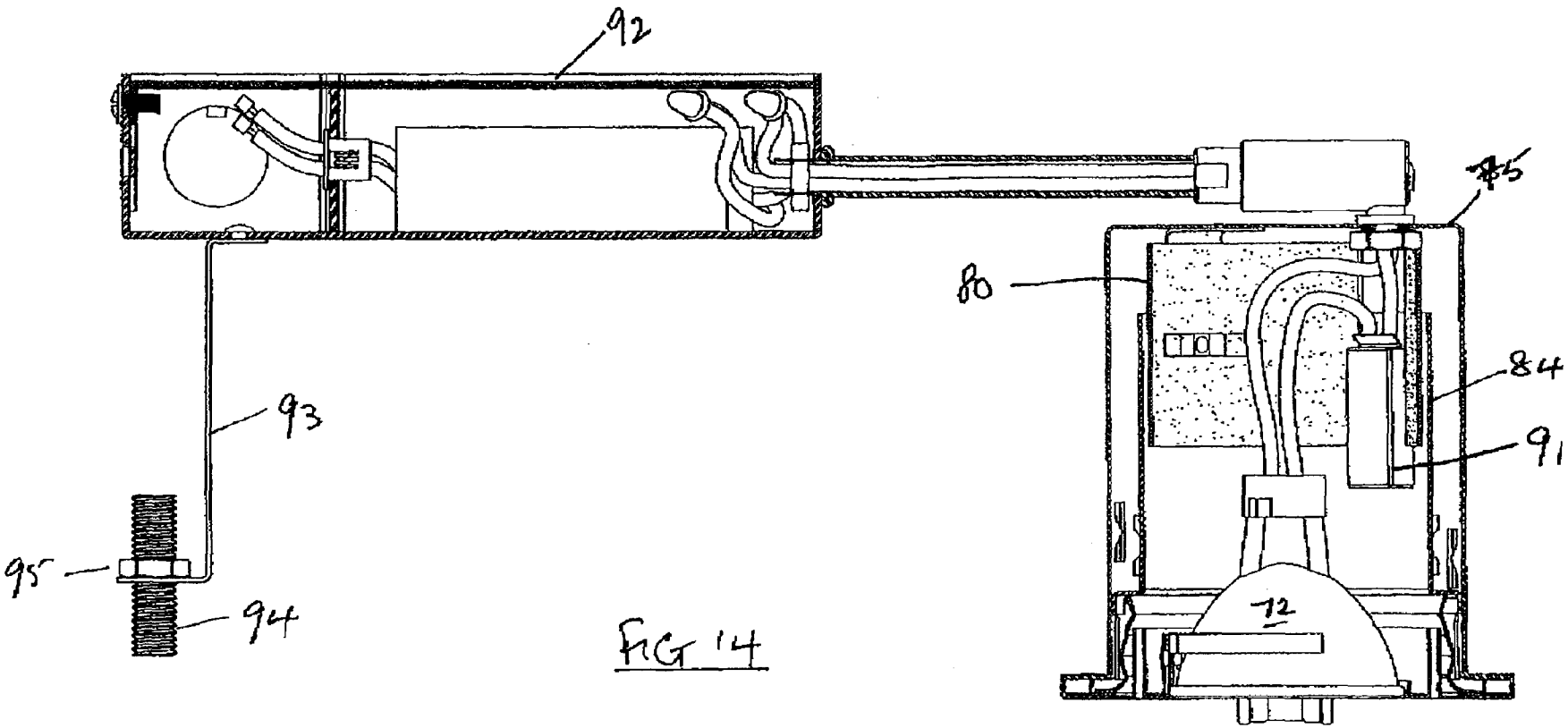
Figure 15:
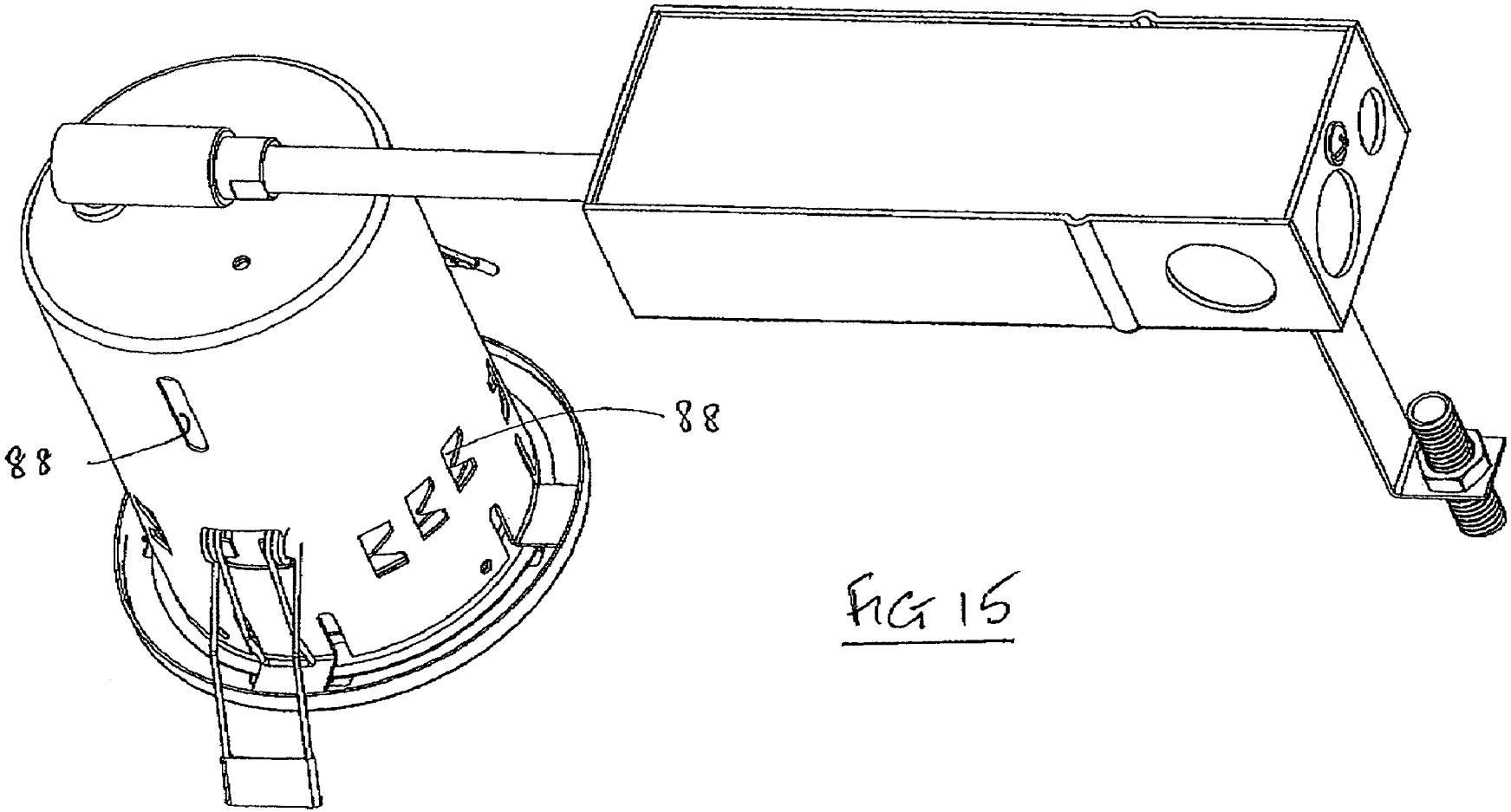

FIG. 14 shows a further cross-sectional view and shows that a thermal cutout switch assembly 91 is included. This is located inside the inner tubular body and its present means that the sleeve of the intumescent material is no longer continuous around the whole circumference of the tubular body.

This particular embodiment includes a transformer assembly 92 which can be supported on the ceiling or other surface into which the downlight is fitted using the adjustable support means 93,94 and 95. A bracket 93, attached to the transformer takes the weight of the transformer in use by means of an adjustable threaded bar or bolt 94 secured in the desired position by lock nut 95.

Figure 16:
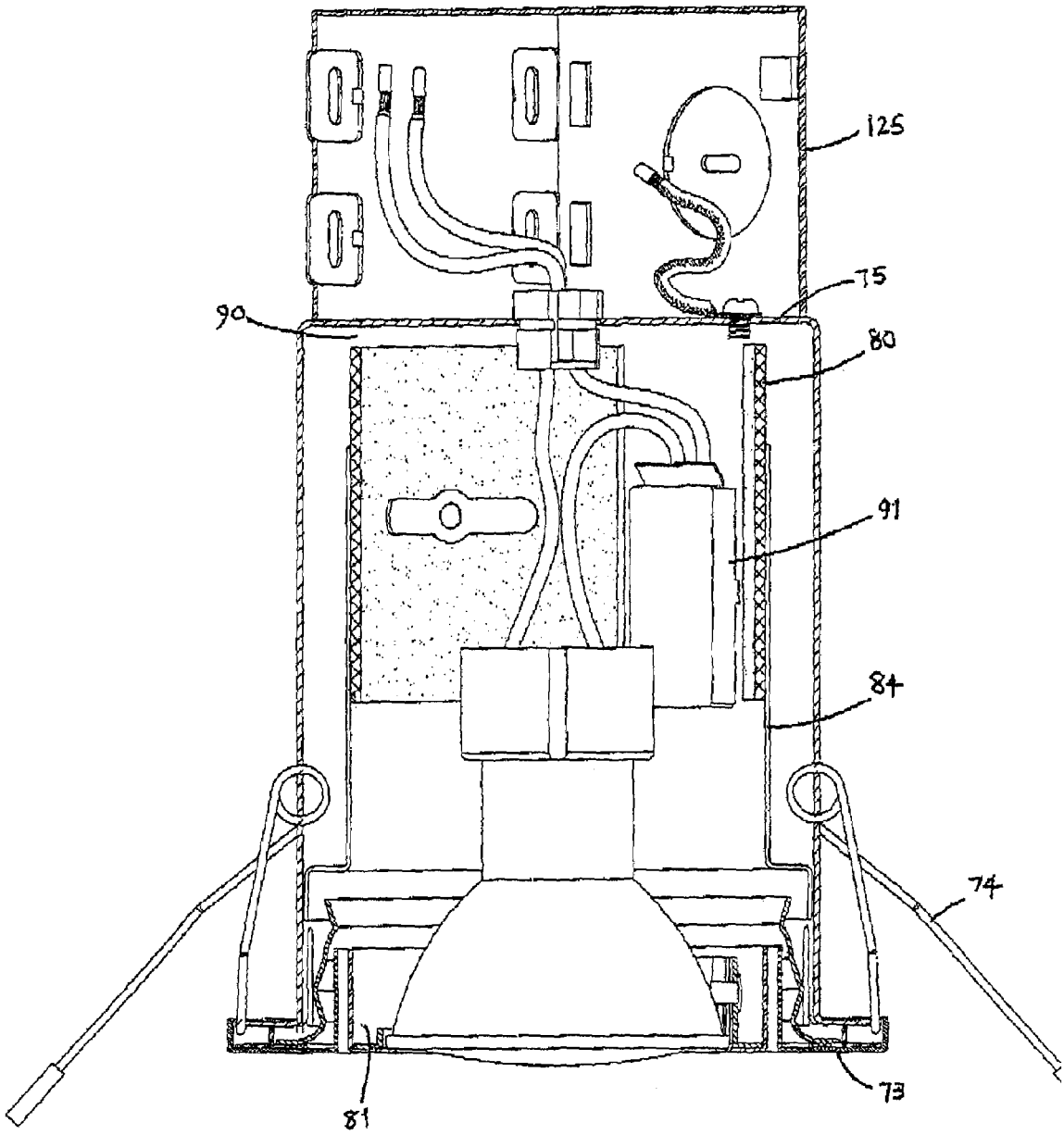
FIGS. 16 and 17 illustrate respectively a longitudinal sectional view from one side and a perspective view of a further embodiment according to the present invention.
Figure 17:
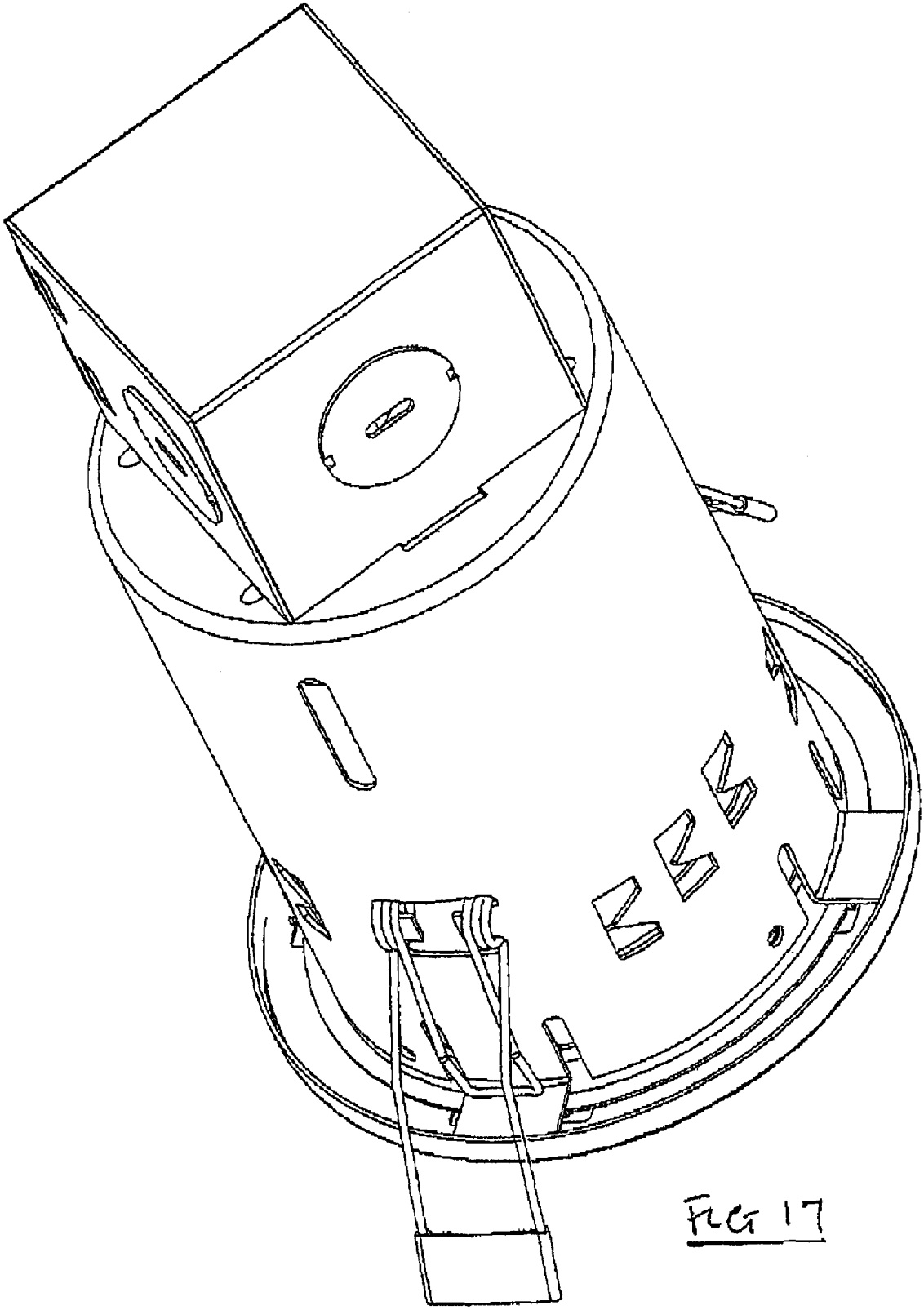

A similar arrangement is shown in FIGS. 16 and 17, in this case for a mains voltage light without a built-in transformer and having instead an integral connection box 125 at the rear end of the casing.

Figure 18:
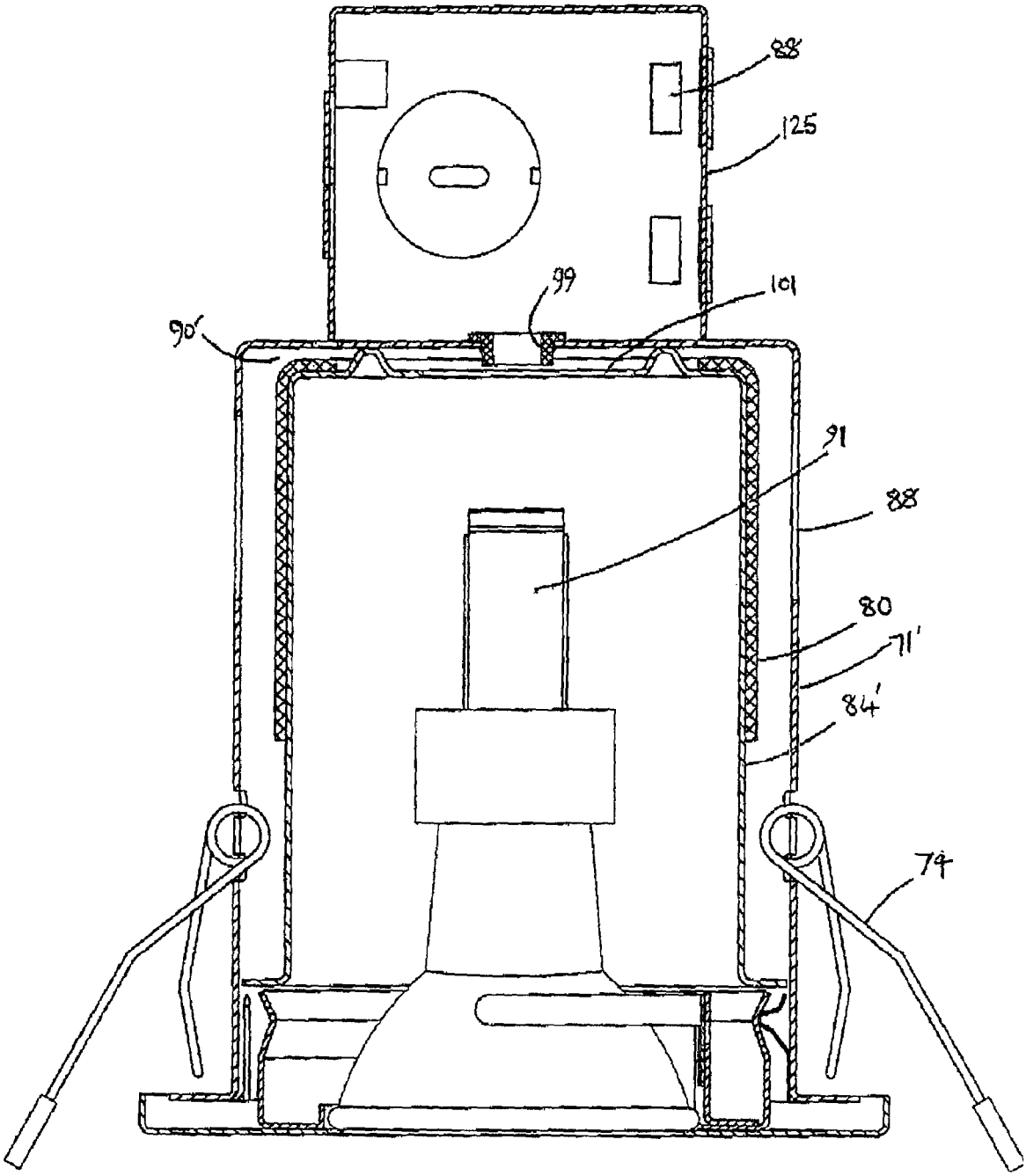
FIG. 18 illustrates a longitudinal sectional view of a further embodiment according to the present invention.

FIG. 18 is a longitudinal sectional view of a further embodiment similar to the preceding embodiment and having inner 84' and outer 71' tubular bodies, but with the intumescent material 80 interposed between the inner and outer tubular bodies, being shown as lining/ coating the external surface of the tubular wall of the inner tubular body 84'. The heated air may flow around the exterior of the inner tubular body 84' and through the gap 90' between the upper end of the inner tubular body 84' and the rear endwall 75 of the outer tubular body 71' up through wiring aperture 99 into the connection box 125 and be vented there from through vent apertures 88 therein; or may flow directly up through the interior of the inner tubular body 84' and through a large central opening 101 in the upper end thereof thence through the wiring aperture 99 into the connection box 125 for venting.

Figure 13:
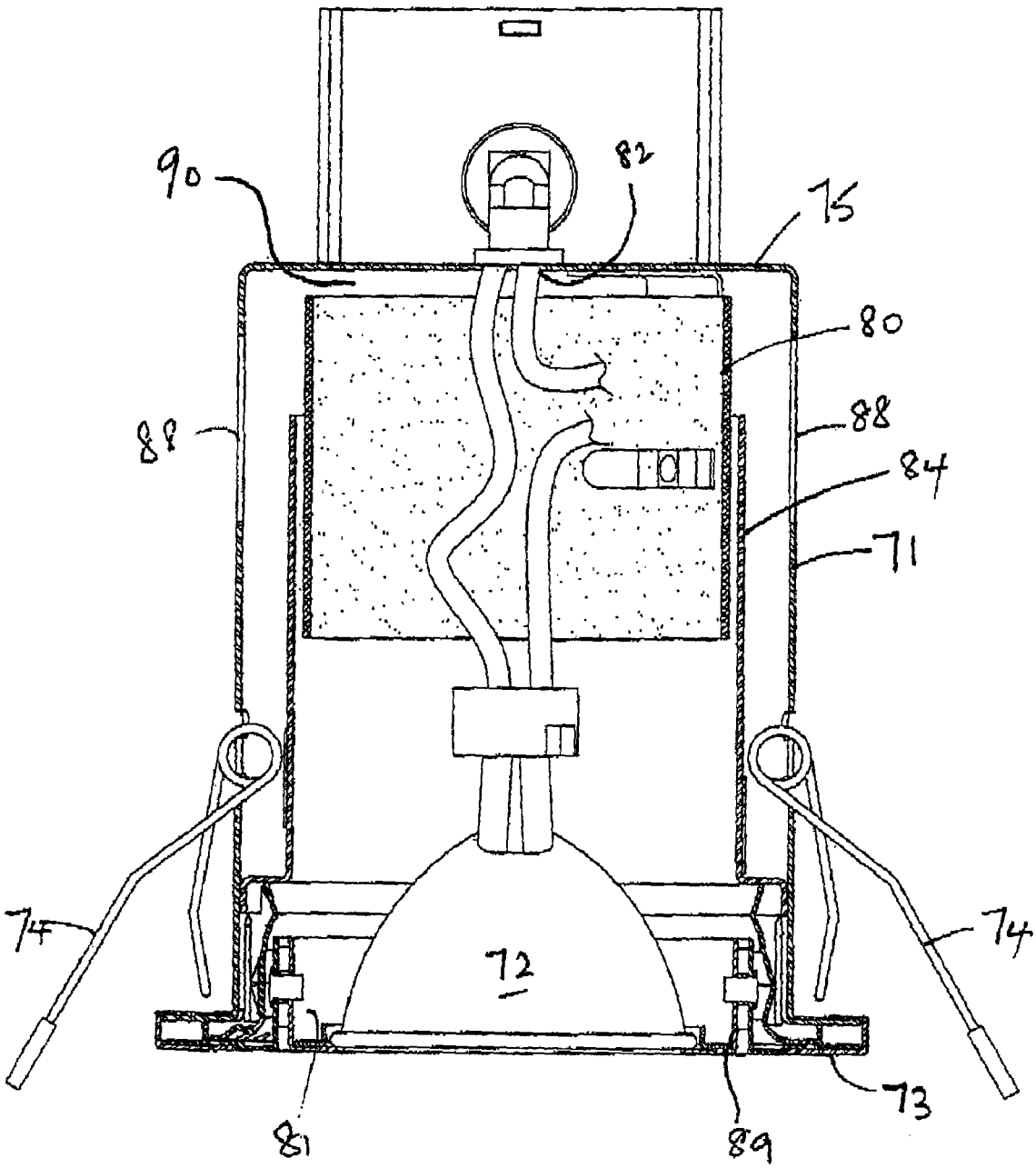
FIGS. 13, 14 and 15 illustrate respectively a longitudinal sectional view from one side, a longitudinal sectional view from a second side, and a perspective view of a further embodiment according to the present invention.
Figure 19:
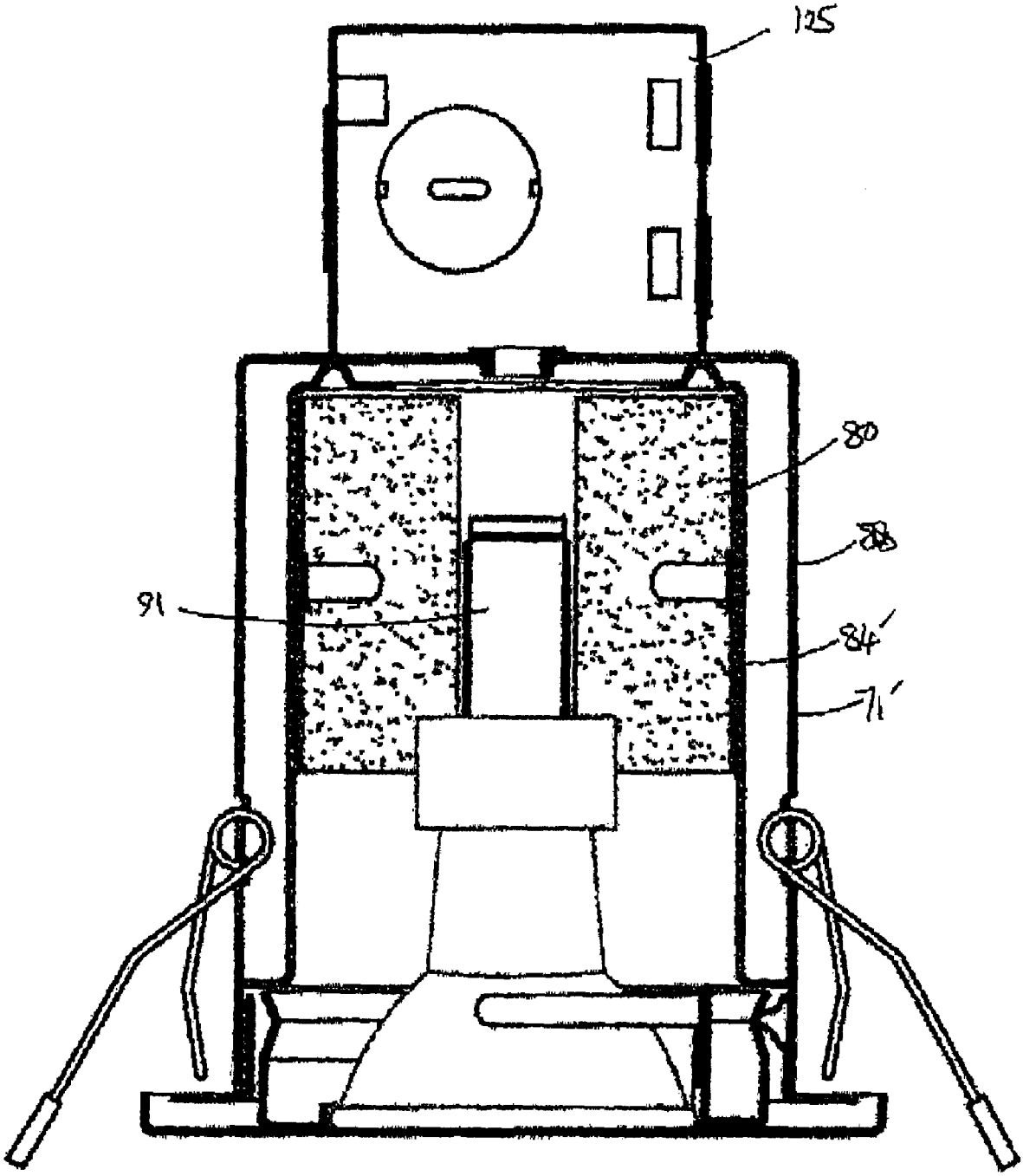
FIGS. 19, 20 and 21 each illustrate a longitudinal sectional view of respective yet further embodiments according to the present invention.
Figure 20:
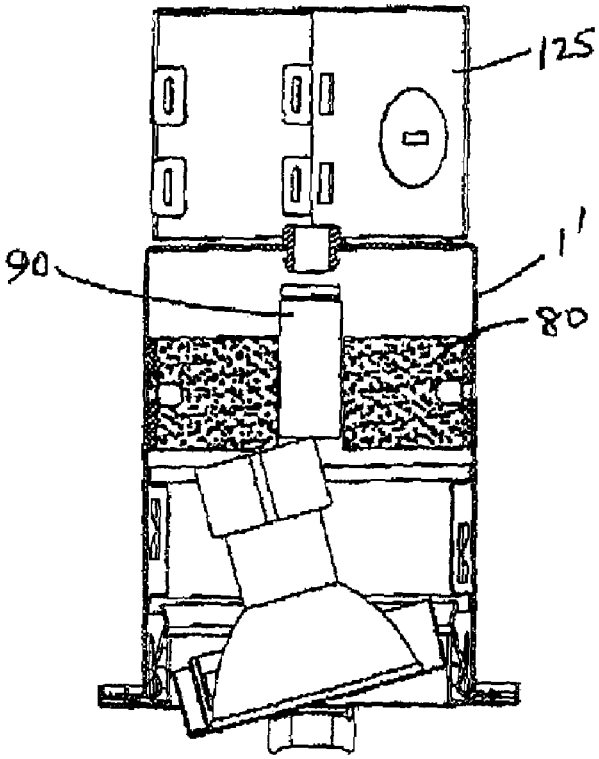
Figure 21:
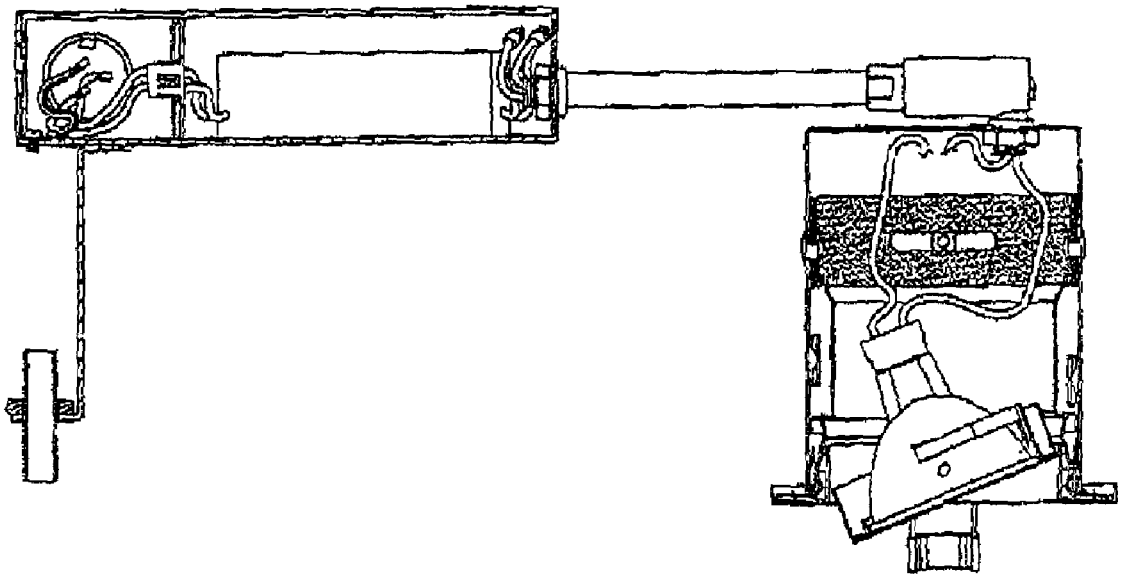

FIG. 19 shows a mains powered embodiment similar to FIG. 18 but in which the intumescent liner 80 internally lines the inner tubular body 84' as per the FIG. 13 embodiment. FIG. 20 shows a mains powered embodiment similar to FIG. 5 in that there is no inner tubular body 84' and the intumescent liner 80 simply internally lines the sole tubular body 1'. Here the lamp is of tilting type. FIG. 21 is the equivalent of the FIG. 20 embodiment but for a low voltage, transformed light.

The invention claimed is:

1. A downlight assembly comprising a casing having a tubular body with a tubular wall having a rear end wall closing the body from the rear, the rear end wall comprising at least one ventilation aperture, wherein the light of the lamp when installed in the tubular body is emitted from the front of the tubular body, said downlight assembly further comprising a sleeve of intumescent material within the tubular body lining the tubular wall of the tubular body or lining the tubular wall of an inner tubular body within said tubular body, the casing comprising, in use, a lamp holder assembly for holding the lamp within the casing, wherein the intumescent sleeve is adapted to expand radially relative to the tubular body in the event of a fire.

2. A downlight assembly claimed in claim 1 wherein the intumescent material takes the form of a continuous or discontinuous sleeve.

3. A downlight assembly as claimed in claim 2 wherein said sleeve is substantially cylindrical.

4. A downlight assembly as claimed in claim 2 wherein the sleeve covers the majority of the internal circumference of the tubular body.

5. A downlight assembly as claimed in claim 1 wherein said intumescent lining terminates short of the front of the tubular body.

6. A downlight assembly as claimed in claim 5 wherein said intumescent lining terminates substantially at the level of the lamp terminal when the lamp is in its operating position.

7. A downlight assembly as claimed in claim 1 wherein the casing comprises an outer tubular body and an inner tubular body with an air gap there between.

8. A downlight assembly as claimed in claim 7 wherein the intumescent material is situated internal to the inner tubular body.

9. A downlight assembly as claimed in claim 7 wherein the intumescent material is situated in the gap between the inner and outer tubular bodies.

10. A downlight assembly as claimed in claim 1 wherein the casing further comprises an annulus of intumescent material around the outer surface of the tubular body near the front of the casing to correspond with the edge of the surface into which the casing is mounted.

11. A downlight assembly as claimed in claim 1 wherein additional intumescent material is provided associated with the rear end wall of the casing.

12. A downlight assembly comprising:

(i) a casing as claimed in claim 1; and (ii) a bulb and associated wiring.

13. A downlight assembly as claimed in claim 12 further comprising:

(iii) a transformer and associated wiring.

14. A downlight assembly as claimed in claim 13 further comprising:

(iv) a thermal cutout switch and associated wiring.

15. A downlight assembly as claimed in claim 1 wherein the casing is sized for installation within a ceiling aperture.

16. A downlight assembly as claimed in claim 1 wherein the casing comprises a plurality of ventilation apertures in the rear end wall of the casing.

17. A downlight assembly as claimed in claim 1 wherein the intumescent sleeve has a rear end and a front end, the front end of the intumescent sleeve terminating short of the front of the tubular body such that, when a lamp is installed in the tubular body, adequate clearance of the intumescent material from the lamp is provided.

18. A downlight assembly as claimed in claim 1 wherein the intumescent sleeve has a rear end and a front end, the rear end of the intumescent sleeve extending from close proximity to the rear end wall of the tubular body, the front end of the intumescent sleeve terminating short of the front of the tubular body, and the intumescent sleeve extending for of the order of up to two thirds the length of the tubular body.

19. A downlight assembly as claimed in claim 1 wherein the intumescent sleeve has a rear end and a front end, the rear end of the intumescent sleeve extending from close proximity to the rear end wall of the tubular body, the front end of the intumescent sleeve terminating short of the front of the tubular body, and the intumescent sleeve extending for of the order of up to half the length of the tubular body.

20. A downlight assembly as claimed in claim 1 wherein the intumescent sleeve has a rear end and a front end, the front end of the intumescent sleeve terminating short of the front of the tubular body by at least 2 cm.

21. A downlight assembly as claimed in claim 1 the downlight assembly further comprising a lamp, wherein the intumescent sleeve has a rear end and a front end, the front end of the intumescent sleeve terminating short of the front of the tubular body and wherein the casing is at least twice as long as the lamp and the front face of the lamp is substantially level with the front of the tubular body.

22. A downlight assembly as claimed in claim 1 wherein the casing is adapted to fully house the lamp within the casing when the lamp is installed, the downlight assembly including wiring for connecting the lamp to a terminal block, transformer, or connection box, the terminal block, transformer, or connection box being mounted to the casing.

23. A downlight assembly as claimed in claim 1 wherein the intumescent sleeve is adapted, in the event of a fire, to expand to fill a void cavity above a lamp, when a lamp is installed in the downlight assembly.

* * * * *